US007978078B2

(12) United States Patent
Copeland et al.

(10) Patent No.: US 7,978,078 B2
(45) Date of Patent: Jul. 12, 2011

(54) MAGNETIC CORE TRANSCEIVER FOR ELECTRONIC ARTICLE SURVEILLANCE MARKER DETECTION

(75) Inventors: Richard L. Copeland, Boynton Beach, FL (US); Brent F. Balch, Ft. Lauderdale, FL (US); Steven W. Embling, Pompano Beach, FL (US); William M. Farrell, West Palm Beach, FL (US); Stewart E. Hall, Wellington, FL (US)

(73) Assignee: Sensormatic Electronics, LLC, Boca Raton, FL (US)

( * ) Notice: Subject to any disclaimer, the term of this patent is extended or adjusted under 35 U.S.C. 154(b) by 1638 days.

(21) Appl. No.: 10/037,337

(22) Filed: Dec. 21, 2001

(65) Prior Publication Data

US 2003/0117282 A1 Jun. 26, 2003

(51) Int. Cl.
*G08B 13/14* (2006.01)

(52) U.S. Cl. ..... 340/572.7; 343/788; 428/379; 428/689; 428/692.1

(58) Field of Classification Search ..... 340/572.7, 340/572.1; 343/718, 788, 787, 741; 342/44, 342/42; 324/243; 728/692.1, 379, 689
See application file for complete search history.

(56) References Cited

U.S. PATENT DOCUMENTS

| | | | | | |
|---|---|---|---|---|---|
| 3,665,449 | A | * | 5/1972 | Elder et al. | 340/572.1 |
| 3,765,007 | A | * | 10/1973 | Elder | 340/572.3 |
| 4,658,263 | A | * | 4/1987 | Urbanski | 343/788 |
| 4,922,261 | A | | 5/1990 | O'Farrell | 343/742 |
| 5,220,338 | A | * | 6/1993 | Matsushita | 343/787 |
| 5,220,339 | A | | 6/1993 | Matsushita | 343/788 |
| 5,327,118 | A | * | 7/1994 | Drucker et al. | 340/572.7 |
| 5,345,222 | A | | 9/1994 | Davies et al. | 340/572 |
| 5,371,490 | A | * | 12/1994 | Martinides | 340/572.4 |
| 5,396,698 | A | | 3/1995 | Orthmann et al. | 29/600 |
| 5,453,747 | A | * | 9/1995 | D'Hont et al. | 342/42 |
| 5,459,451 | A | * | 10/1995 | Crossfield et al. | 340/572.7 |
| 5,499,017 | A | * | 3/1996 | Beigel | 340/572.1 |
| 5,561,430 | A | * | 10/1996 | Knebelkamp | 342/44 |
| 5,567,537 | A | | 10/1996 | Yoshizawa et al. | 428/692 |
| 5,625,366 | A | * | 4/1997 | D'Hont | 343/718 |
| 5,638,080 | A | | 6/1997 | Orthmann et al. | 343/788 |
| 5,729,200 | A | | 3/1998 | Copeland et al. | 340/551 |
| 6,014,111 | A | * | 1/2000 | Johannessen | 343/788 |
| 6,060,988 | A | | 5/2000 | Copeland et al. | 340/572.1 |
| 6,118,378 | A | | 9/2000 | Balch et al. | 340/572.7 |
| 6,172,608 | B1 | * | 1/2001 | Cole | 340/572.1 |

(Continued)

FOREIGN PATENT DOCUMENTS

EP 0762535 B1 11/1998

*Primary Examiner* — Benjamin C Lee

(74) *Attorney, Agent, or Firm* — Alan M. Weisberg; Christopher & Weisberg, P.A.

(57) ABSTRACT

A magnetic core transceiver antenna for EAS marker detection is provided. The core includes a stack of amorphous alloy ribbons insulated from each other and laminated together. A coil winding of wire, also insulted from the ribbons, and connected to an electronic controller provides the transmitter and receiver modes. The transceiver antenna is optimized for the dual mode operation, and is smaller and uses less power than conventional air-core EAS antennas with equivalent performance. Complex core geometries, such as a sandwiched stack of different sized ribbons, can be implemented to vary the effective permeability of the core to customize antenna performance. Multiple transceiver antennas can be combined to increase the size of the generated EAS interrogation zone.

10 Claims, 8 Drawing Sheets

U.S. PATENT DOCUMENTS 6,181,245 B1 1/2001 Copeland et al. ..... 340/551

6,268,723 B1 * 7/2001 Hash et al. ..... 324/243

6,304,182 B1 * 10/2001 Mori et al. ..... 340/572.1

6,307,517 B1 * 10/2001 Lee ..... 343/741

6,351,215 B2 * 2/2002 Rodgers et al. ..... 340/572.1

* cited by examiner

MAGNETIC CORE TRANSCEIVER FOR ELECTRONIC ARTICLE SURVEILLANCE MARKER DETECTION

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

This invention relates to electronic article surveillance systems, and more particularly to a transceiver antenna having a core made of an amorphous magnetic material for electronic article surveillance marker detection.

2. Description of the Related Art

Electronic article surveillance (EAS) systems are typically used to protect assets including reducing theft of retail articles. In operation, an EAS interrogation zone is established around the perimeter of a protected area such as the exits of a retail store. EAS markers, which are detectable within the interrogation zone, are attached to each asset or article to be protected. The interrogation zone is established by EAS antennas positioned for example, in the vicinity of the store's exit. The EAS antennas transmit an electromagnetic interrogation field, which causes a response from an active EAS marker in the interrogation zone. The EAS antennas receive and the EAS electronics detect the EAS marker's response, which indicates an article, with an attached EAS marker, is in the interrogation zone. EAS markers are removed, or the markers deactivated, for articles purchased or otherwise authorized for removal from the store or protected area. Hence, an EAS marker detected within the interrogation zone indicates that an article is attempting to be removed from the protected area, or store, without authorization, and appropriate action can be taken.

The EAS antennas, which are typically made of air core coils of wire, may be configured as separate transmit and receive antennas, or as transceiver antennas. These conventional EAS air-core antennas must generate interrogation zones that are sufficient to cover stores that have very wide exits, and are relatively large. In food and other stores, having narrow aisles the smallest antennas possible are desired. In these narrow aisle environments EAS antennas must operate near metal surfaces and check-stands, which can result in degraded performance. Expensive, large, and heavy shielding is required for conventional air-core EAS antennas for effective operation in this environment. There exists a need for smaller EAS antennas that perform satisfactorily, especially in tight spaces and near metal surfaces.

The use of ferrite core EAS receive antennas is well known. Ferrite material is a powder, which is blended, compressed into a particular shape, and then sintered in a very high temperature oven. It is a compound that becomes a fully crystalline structure after sintering. Ferrite has a higher magnetic permeability than air effectively increasing the detection performance of a ferrite core antenna. A ferrite core receiver antenna sold by Sensormatic uses a manganese zinc ferrite rod about 19 cm long and 0.6 cm in diameter with magnet wire wound about the surface. However, in certain EAS frequency bands of interest and at required levels of excitation field, ferrite cores may saturate before producing an interrogation field suitable for detecting EAS markers at a useable distance.

The use of amorphous magnetic material core antennas is known for certain receiver applications. U.S. Pat. No. 5,220,339, to Matsushita, discloses a receiver antenna having an amorphous core for UHF and VHF television frequency reception. The '339 patent discloses two magnetic core geometries. The first core geometry is a solid cylindrical shape made of amorphous fibers. The second core geometry is a hollow cylindrical shape made of an amorphous sheet spiral rolled to form a hollow cylinder. A conductive insulated winding surrounds each core. The magnetic permeability of amorphous metal is significantly higher than ferrite, indicating improved reception performance in comparison to a ferrite core at certain frequencies. The '339 patent provides no useable information or teaching directed toward transmitting using an amorphous core antenna.

U.S. Pat. No. 5,567,537, to Yoshizawa et al., discloses a passive transponder antenna using a magnetic core for identification systems applications. A remote transmitter field source produces an induced voltage on the transponder antenna that energizes the transponder transmitting/receiving device, which then transmits a digital code to a remote receiver antenna. The transponder core antenna uses a very thin magnetic core and is not directly coupled to the electronics that powers the remote transmitter and receiver antennas. The magnetic core element, which can be an amorphous alloy, is 25 microns thick or less. A thickness greater than 25 microns is not suitable due to decreased Q and lower sensitivity. The lower the thickness, the better the performance, and, as stated in the '537 patent at column 5, lines 1-6, 15 microns thickness is better than 25 microns. The thickness of the laminated core antenna, which is made up of a plurality of core elements, is disclosed to be 3 mm or less. The target frequency for the identification system is 134 kHz. The preferred Q value is greater than 25 or 35, or even more, at the 134 kHz frequency. The power levels operating the passive transponder are quite low, and the level of magnetic field transmitted by such a device is extremely low.

BRIEF SUMMARY OF THE INVENTION

The present invention is an electronic article surveillance antenna for generating an electromagnetic field to interrogate and detect electronic article surveillance markers. Including a core formed by a plurality of amorphous alloy ribbons insulated from each other and stacked to form a substantially elongated solid rectangular shape. A coil winding of wire disposed around at least a portion of the core, the coil winding of wire insulated from the core, the core and the coil winding being of a minimum size for generation of an electromagnetic field for interrogation and detection of electronic article surveillance markers.

In one embodiment the antenna has a core about 75 centimeters long and about 2 centimeters wide made with about 60 amorphous alloy ribbons, each amorphous alloy ribbon is about 23 microns thick stacked and laminated together to form the core. The coil winding of wire can be 24-gauge wire with about 90 turns around the core.

In an alternate embodiment the antenna includes a central core member about 50 centimeters long and about 2 centimeters wide made of about 25 amorphous alloy ribbons, each amorphous alloy ribbon about 23 microns thick stacked and laminated together forming the central core member. A first outer member and a second outer member are disposed on opposite sides of the central member. Each of the first second outer members are about 30 centimeters long and 2 centimeters wide made of about 15 amorphous alloy ribbons, each amorphous alloy ribbon about 23 microns thick stacked and laminated together forming the first and second outer layer, respectively. The central core member and the first and second outer members together form the core.

One embodiment for an electronic controller is connected to said coil winding or wire and includes a transmitter for generating an electromagnetic field for transmission into an interrogation zone for reception by an electronic article surveillance marker, the electronic article surveillance marker responding with a characteristic response signal. And, a receiver for detecting the characteristic response signal from the electronic article surveillance marker, and a switching controller for switching the coil winding of wire between the transmitter and the receiver. The electronic controller can operate in a pulsed mode where the switching controller sequentially switches between the transmitter and the receiver in preselected time periods.

Objectives, advantages, and applications of the present invention will be made apparent by the following detailed description of embodiments of the invention.

DETAILED DESCRIPTION OF THE INVENTION

Figure 1:
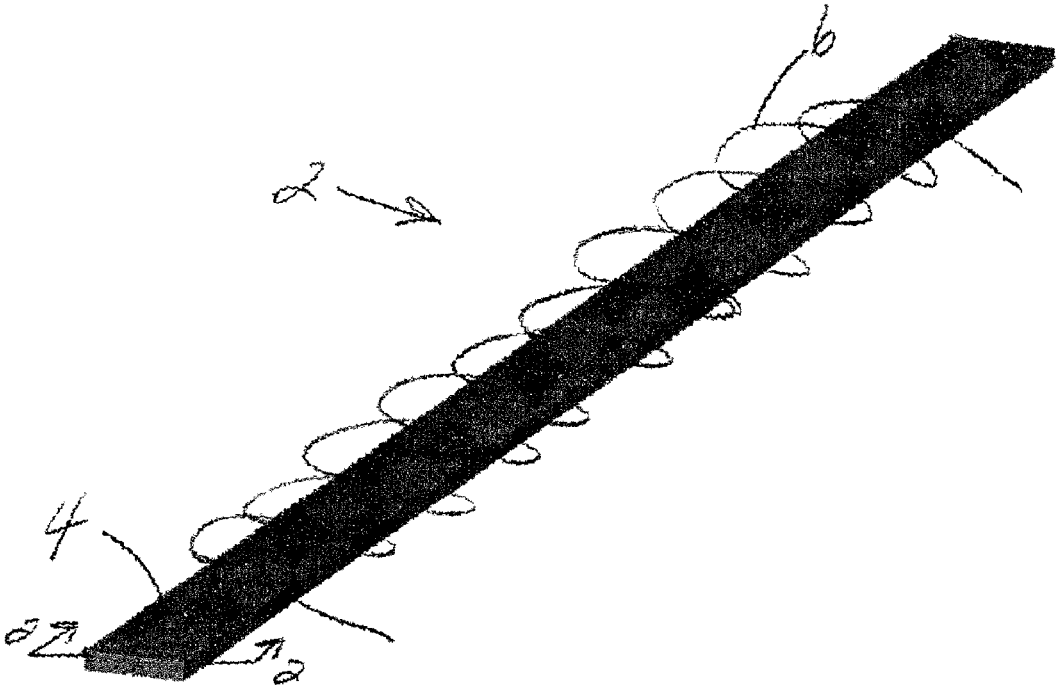
FIG. 1 is a perspective view of one embodiment of the amorphous core transceiver antenna.

Referring to FIG. 1, one embodiment of the disclosed amorphous core transceiver antenna 2 consists of an amorphous core 4 surrounded by a wire coil winding 6 which is directly connected to control electronics, as fully described hereinbelow, to generate an electromagnetic field for EAS marker detection. Preferably an insulating layer (not shown) is placed between the core 4 and the coil winding 6.

Figure 2:
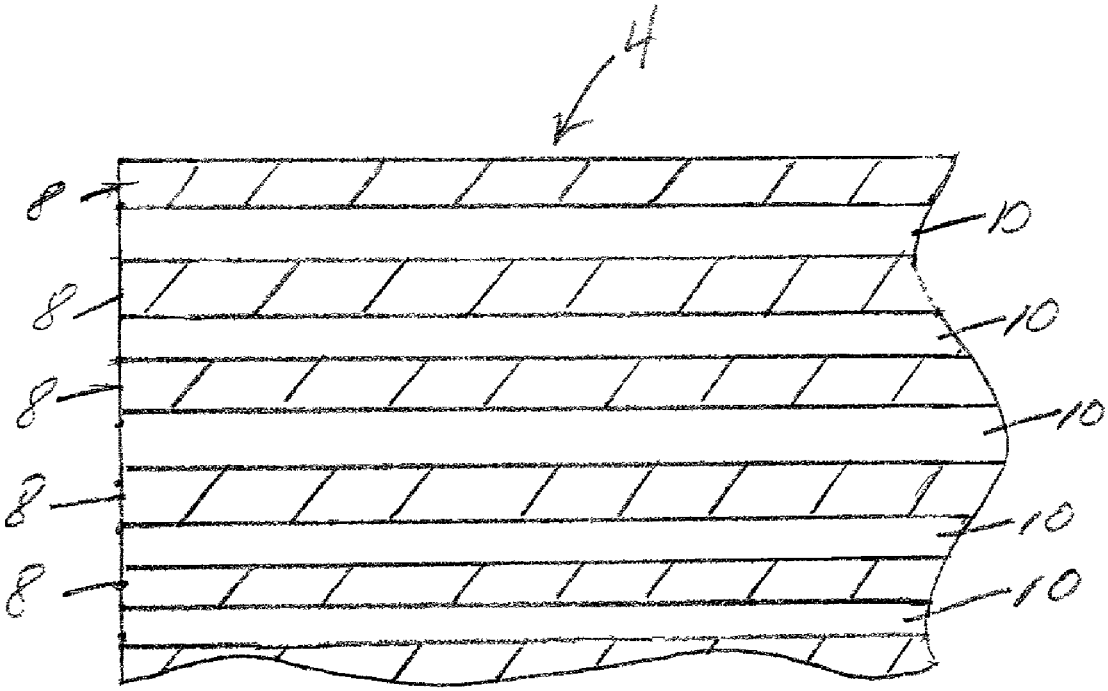
FIG. 2 is a partial cross-sectional view taken along line 2-2 in FIG. 1.

Referring to FIG. 2, the amorphous core 4 consists of a stack of amorphous ribbons 8, which are preferably laminated together with a suitable insulation coating 10, such as an acrylic lacquer, plastic, paint, varnish, or the like, to electrically isolate each ribbon from adjacent ribbons to reduce eddy current losses. The amorphous core 4 and coil winding 6 are optimized according to the desired frequency of operation. Preferred dimensions of the amorphous core antenna 2, for operation at an EAS frequency of about 58 kHz, are about 75 cm. long by about 2 cm. wide, with the core (4) stack preferably containing 60 ribbons (8) that are each about 23 microns thick. The corresponding coil winding of wire (6) is 24-gauge insulated wire with about 90 turns positioned around the full extent of amorphous core (4). The number of windings can vary from 50 to 100, or more, depending on the core configuration, the frequency of operation, and desired impedance. The ribbons (8) are a suitable amorphous alloy, such as VC6025F available from Vacuumschmelze GmBH Co. (D-6450 Hanau, Germany), or other amorphous alloy with similar magnetic properties, and which are transverse field annealed in order to produce a linear permeability at relatively low magnetic field levels. The transverse field annealing also results in lower core losses than for as-cast materials or for longitudinal field annealing.

The magnetic properties and geometry of the core 4 used in the core transceiver antenna 2 are optimized to perform the dual role of transmitter and receiver antenna. It is important that the core doesn't saturate during the excitation pulse. It is also important for the receiver antenna sensitivity to be optimized by achieving the maximum effective permeability at low magnetic field levels. There are several compromising situations arising in the dual role of the transceiver core antenna. To prevent saturation, the core volume needs to be a minimum size. For a fixed length, this is achieved by increasing the width of the material or the number of ribbons in the stack. For the receiver antenna sensitivity to be optimized, the effective permeability must be maximized. This means that for a given core length, the cross-sectional area (product of width and overall thickness) must be minimized to a sufficient degree. An acceptable compromise between these competing parameters can occur for a core geometry consisting of a length of about 75 cm. and a cross-sectional area of about 0.276 cm.$^2$, as illustrated in FIG. 1.

Figure 3:
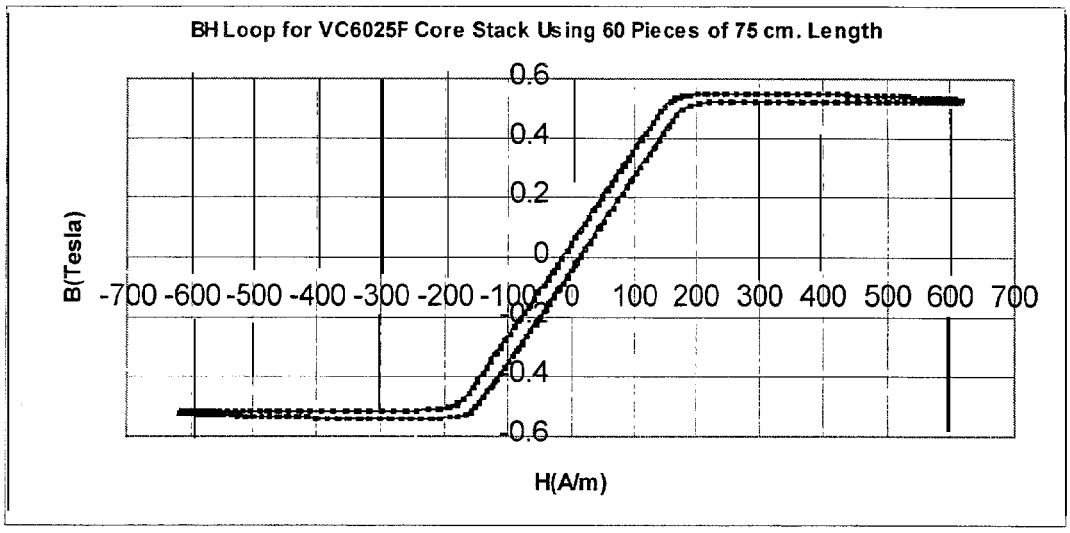
FIG. 3 is a BH hysteresis curve for the amorphous core shown in FIG. 1.
Figure 4:
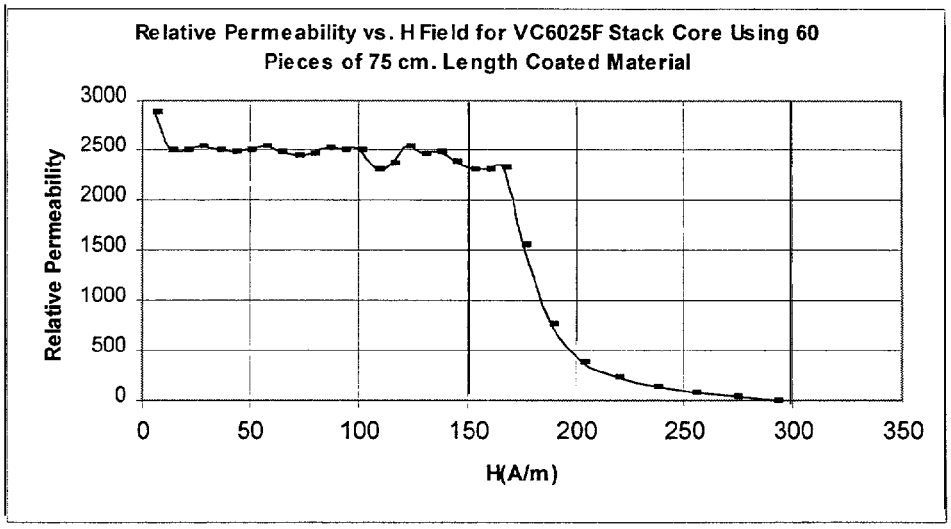
FIG. 4 is a plot of relative permeability verses H-field of the amorphous core shown in FIG. 1.

FIG. 3, illustrates a BH hysteresis curve for a 75 cm. long, 2 cm. wide core (4) of 60 ribbons (8) of 23 micron thickness each that have been coated with an insulation coating (10), as shown in FIG. 2. FIG. 4 illustrates the relative permeability verses H-field of the same core (4) of FIG. 3. As illustrated, the relative permeability is fairly constant at a value of about 2500 and then declines rapidly at an H-field of about 170 A/m as the material starts to saturate. Beyond 170 A/m the amorphous core antenna 2 performance for both transmit and receive modes is greatly reduced. A simple rectangular cross-sectional magnetic core when wound with a coil along most of its length will first experience saturation in the central region of the core. The magnetic field decreases toward the ends of the core. This is a simple demagnetization effect. The hysteresis loop for a simple rectangular core, as shown in FIG. 3, has two regions: (1) a linear region at fields below saturation (H between about +/−170 A/m) and (2) a flat region at saturation (H above and below +/−170 A/m, respectively). The slope of the linear region determines the permeability. For better receiver antenna operation, the higher the permeability. However, when you reach saturation the permeability drops off dramatically, as shown in FIG. 4.

Figure 5:
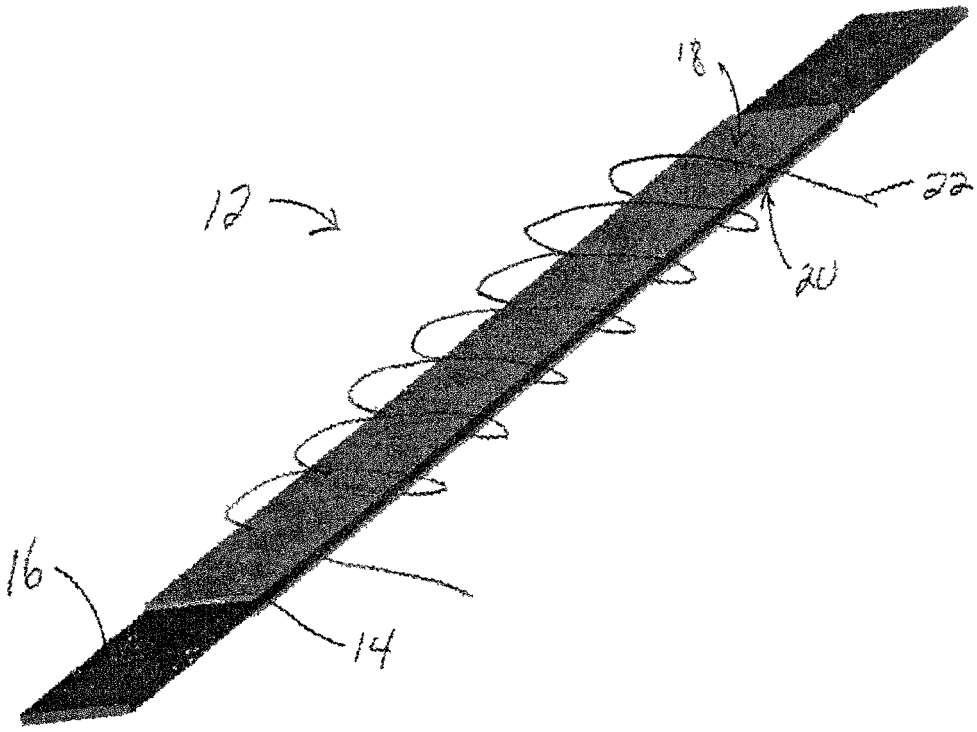
FIG. 5 is a perspective view of an alternate embodiment of the amorphous core transceiver antenna.

Referring to FIG. 5, an alternate embodiment of the present invention is illustrated. Amorphous core transceiver antenna 12 consists of an amorphous core 14 having a central core member 6, disposed between a top core member 18 and a bottom core member 20, all wound with coil winding 22. An insulating layer (not shown) can be placed between the core 14 and the coil winding 22. Preferably, for operation at an EAS frequency of about 58 kHz (typical for magnetomechanical or acoustomagnetic EAS systems) the central core member 16 is about 50 cm. long by about 2 cm. wide with 25 amorphous ribbons, each about 23 microns thick, stacked in the same manner illustrated in FIG. 2. Top core member 18 and bottom core member 20 both being about 35 cm. in length by 2 cm. wide, with 15 amorphous ribbons, each about 23 microns thick, stacked in the same manner illustrated in FIG. 2.

Figure 6:
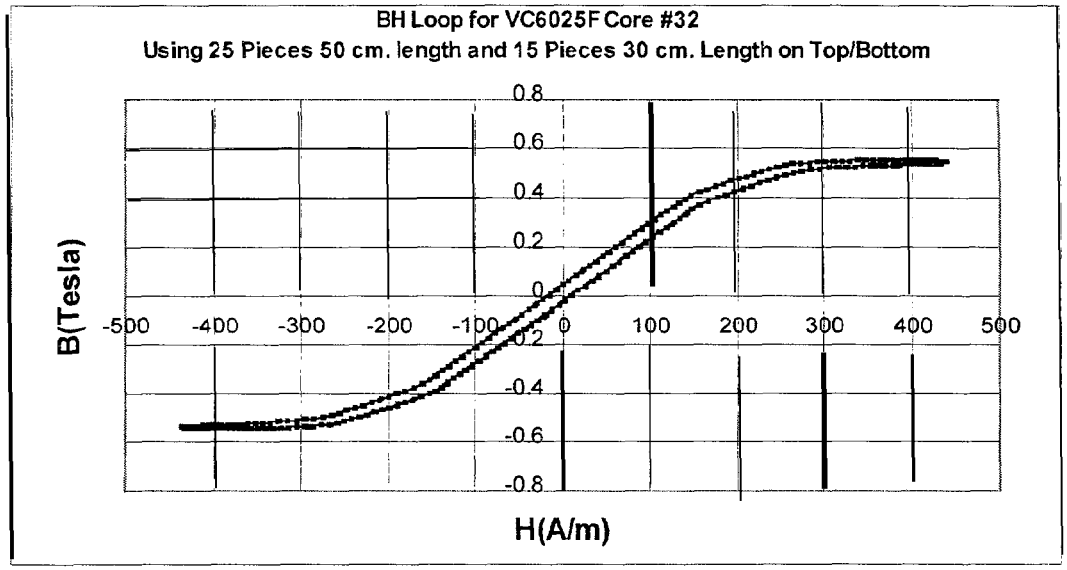
FIG. 6 is a BH hysteresis curve for the amorphous core shown in FIG. 5.
Figure 7:
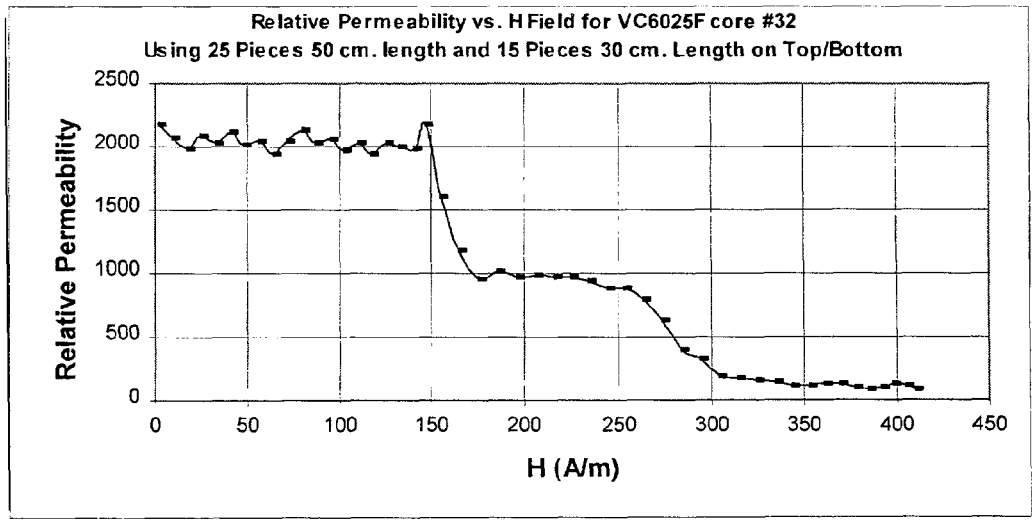
FIG. 7 is a plot of relative permeability verses H-field for the amorphous core shown in FIG. 5

FIG. 6 illustrates a BH hysteresis curve for an amorphous core antenna 12 configuration as described hereinabove and as illustrated in FIG. 5. FIG. 7 illustrates the relative permeability verses H-field for the amorphous core antenna 12 configuration as described hereinabove and as illustrated in FIG. 5. The amorphous core antenna 12 produces a more uniform magnetic field distribution inside of the core region in comparison to the simple rectangular geometry of amorphous core antenna 2, and produces a two step permeability curve shown in FIG. 7. For the sandwich core configuration illustrated, the added material in the central region prevents the central region of the core from saturating before the end regions of the core saturate. The two-step hysteresis loop illustrated in FIG. 6 is produced, and which is more pronounced in the permeability vs. H curve shown in FIG. 7. While the permeability of about 2000 falls off at about 160 A/m, saturation occurs at a higher H of about 270 A/m.

The quality factor Q if the amorphous core transceiver antennas is defined as follows, $$Q = \frac{2\pi f L}{R},$$

where f is the operating frequency, L the inductance, and R the resistance. Q plays an important role in both transmit and receive modes of the antenna. Generally, a higher value of Q enhances detection sensitivity, but due to the transmit function using the same core, the value of Q is typically limited to 20 or less. Limiting Q to 20 or less prevents ringing of the transmitter signal into the nearby receiver window (as fully explained hereinbelow), causing false detections. Referring back to FIG. 2, the insulation coating 10 between the ribbons 8 is very important to the overall performance of the core antenna. The effective permeability and Q are dramatically reduced when the ribbons 8 in the core stack are allowed to touch.

Figure 8:
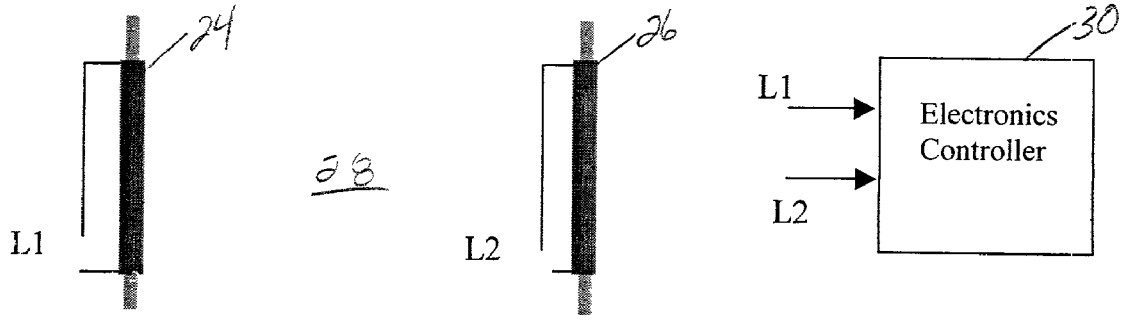
FIG. 8 is a schematic illustration showing an operational configuration of the present invention using two amorphous core transceivers.

Referring to FIG. 8, an array of two amorphous core transceiver antennas 24, 26 can offer substantially improved detection of an EAS marker (not shown) in a typical aisle environment, which may have a maximum zone width of about 100 cm. An array of two amorphous core transceiver antennas 24, 26 increases the size of the effective interrogation zone 28. The two antennas 24, 26 are connected to an electronics controller 30, were L1 and L2 represent the antenna loads. The two amorphous core transceiver antennas 24, 26 may be phase switched to optimize detection performance. See U.S. Pat. No. 6,118,378, to Balch et al., the disclosure of which is incorporated herein by reference. Alternately, the amorphous core transceiver antennas 24 and 26 can operate in a transmit only mode or a receive only mode so that one of the antennas 24, 26 would transmit and the other would receive.

Figure 9:
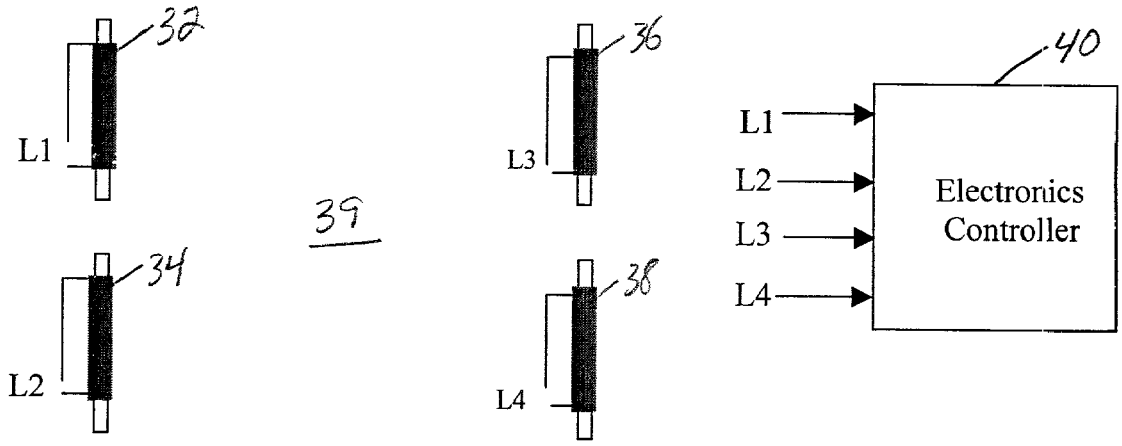
FIG. 9 is a schematic illustration showing an operational configuration of the present invention using four amorphous core transceivers.

Referring to FIG. 9, an array of four amorphous core transceiver antennas 32, 34, 36, 38 may be used to cover an interrogation zone 39. The four antennas 32, 34, 36, 38 are connected to an electronics controller 40, were L1, L2, L2, and L4 represent the antenna loads. A four-element antenna array allows more phase modes and improved detection performance compared to a one or two-element array. Electronics controllers 40, and 30 shown in FIG. 8, can be adapted to generate pulsed or continuous waveform detection schemes, including swept frequency, frequency hopping, frequency shift keying, amplitude modulation, frequency modulation, and the like, depending on the specific design of the desired EAS system.

Figure 10:
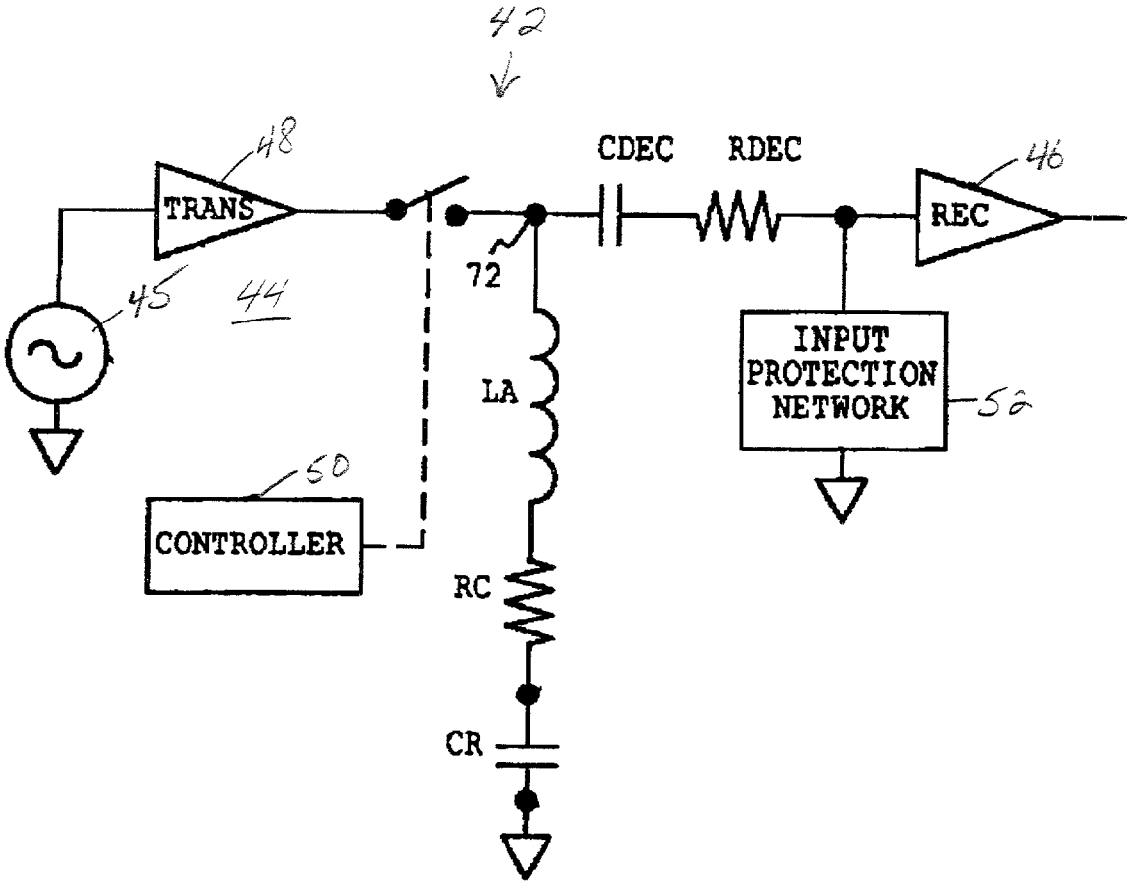
FIG. 10 is a schematic illustration showing one embodiment of control electronics for the present invention.

Referring to FIG. 10, one embodiment of control electronics 42 is illustrated for driving the amorphous core transceiver antennas 2, 12, which are used herein to describe the invention. The control electronics 42 energizing the core transceiver antenna consists of a transmitter drive circuit 44, which includes signal generator 45 and transmitter amplifier 48, and a receiver circuit 46. The transmitter drive circuit 44 energizes the amorphous core antenna, represented by the inductor $L_A$ and resister $R_C$, and resonating capacitor $C_R$, with about 200 A-turns of excitation at an operating frequency of about 58 kHz for a short period of time. This transmitter burst applied to the amorphous core antenna 2, 12 produces a substantial magnetic field level at distances up to 50 cm. or more from the antenna. The excitation magnetic field level is sufficient, out to 50 cm, to excite EAS markers of the type described in U.S. Pat. Nos. 5,729,200 and 6,181,245 B1, to Copeland et al., the disclosures of which are incorporated herein by reference. EAS markers excited by this interrogation electromagnetic field produce sufficient response signal levels for detection when the amorphous core antenna is connected to the receiver circuit. Preferably, a transmitter burst occurs for approximately 1.6 ms where the transmitter amplifier 48 is directly connected to the amorphous core antenna at 72. After a very short delay following the transmitter burst, the amorphous core antenna at 72 is directly connected to the receiver circuit 46 by the controller 50. Controller 50 achieves the switching of the antenna into and out of the circuit to effectively switch back and forth from transmitter to receiver modes. During the 1.6 ms transmitter pulse the receiver circuit 46 is isolated from the antenna load at 72 through the decoupling network CDEC and RDEC, and the input protection network 52. After the transmission pulse, there is a subsequent delay to allow the energy from the transmitter circuit to fully dissipate. Afterwards, the controller 50 disconnects the transmitter amplifier 48 from the antenna at 72, leaving the receiver circuit 46 connected to the antenna at 72. The alternating transmitter connection to the antenna load at 72 continues, and with the receiver connection, establishes an EAS interrogation zone for detection of EAS markers.

It is to be understood that variations and modifications of the present invention can be made without departing from the scope of the invention. For example, the present invention contemplates complex core configurations, other than the two examples provided herein, which may enhance core performance, as well as other frequency bands of operation. It is also to be understood that the scope of the invention is not to be interpreted as limited to the specific embodiments disclosed herein, but only in accordance with the appended claims when read in light of the forgoing disclosure.

What is claimed is:

1. An electronic article surveillance antenna for generating an electromagnetic field to interrogate and detect electronic surveillance markers, comprising:

a core formed by a plurality of amorphous alloy ribbons insulated from each other and stacked to form a substantially elongated solid rectangular shape; and a coil winding of wire disposed around at least a portion of said core, said coil winding of wire insulated from said core, said core and said coil winding being of a minimum size for generation of an electromagnetic field for interrogation and detection of electronic article surveillance markers; wherein said core includes a central member about 50 centimeters long and about 2 centimeters wide comprised of about 25 amorphous alloy ribbons, each amorphous alloy ribbon about 23 microns thick stacked and laminated together forming said central core member, and a first outer member and a second outer member disposed on opposite sides of said central member, each of said first outer member and said second outer member about 30 centimeters long and 2 centimeters wide comprised of about 15 amorphous alloy ribbons, each amorphous alloy ribbon about 23 microns thick stacked and laminated together forming said first outer layer and said second outer layer, respectively, said central core member and said first and said second outer members together form said core.

2. An electronic article surveillance system for generating an electromagnetic field to interrogate and detect electronic surveillance markers, comprising:

a core including a plurality of amorphous alloy ribbons insulated from each other and stacked to form an elongate solid rectangular shape; and a coil winding of wire disposed around at least a portion of said core, said coil winding of wire insulated from said core, said core and said coil winding being configured for generating an electromagnetic field for interrogation and detection of electronic article surveillance markers, wherein said core comprises a central member disposed between a first outer member and a second outer member, wherein at least a portion of said central member extends beyond an end portion of one of said first and second outer members.

3. The system of claim 2, wherein said first outer member has a first length, said second outer member has a second length, said first length substantially equal to said second length.

4. The system of claim 3, wherein said central member has a third length, said third length greater than said first length and said second length.

5. The system of claim 4, wherein said first length and said second length are about 30 centimeters and said third length is about 50 centimeters.

6. An antenna for use in an electronic article surveillance system, said antenna comprising:

a core comprising a central member disposed between a first outer member and a second outer member, wherein at least a portion of said central member extends beyond an end portion of one of said first and second outer members; and a coil winding disposed around at least a portion of said core.

7. The antenna of claim 6, wherein said first outer member has a first length, said second outer member has a second length, said first length substantially equal to said second length.

8. The antenna of claim 7, wherein said central member has a third length, said third length greater than said first length and said second length.

9. The antenna of claim 8, wherein said first length and said second length are about 30 centimeters and said third length is about 50 centimeters.

10. A system for generating an electromagnetic field to interrogate and detect electronic article surveillance markers, comprising:

a plurality of electronic article surveillance antennas, each of said plurality of antennas including:

a core formed by a plurality of amorphous alloy ribbons insulated from each other and stacked to form an elongate solid rectangular shape having first and second ends; and a coil winding of wire disposed around at least a portion of said core, said coil winding of wire insulated from said core, said core and said coil winding being of at least a minimum size for operably generating an electromagnetic field for interrogation and detection of electronic article surveillance markers; and, at least one electronic controller connected to said plurality of antennas, said electronic controller including:

transmitter means for generating an electromagnetic field for transmission into an interrogation zone for reception by an electronic article surveillance marker, the electronic article surveillance marker responding with a characteristic response signal;

receiver means for detecting the characteristic response signal from the electronic article surveillance marker; and, switching means for switching said coil winding of wire between said transmitter means and said receiver means;

wherein a Q value of at least one of said antennas is less than or equal to about 20 at an EAS operating frequency.

* * * * *